US006428587B1

(12) United States Patent
Ito

(10) Patent No.: US 6,428,587 B1
(45) Date of Patent: Aug. 6, 2002

(54) VITRIFIED ABRASIVE SOLID MASS HAVING PORES FILLED WITH RESIN, AND SOLID LUBRICANT AGENT

(75) Inventor: Kenji Ito, Gifu-ken (JP)

(73) Assignee: Noritake Co., Limited, Nagoya (JP)

( * ) Notice: Subject to any disclaimer, the term of this patent is extended or adjusted under 35 U.S.C. 154(b) by 0 days.

(21) Appl. No.: 09/920,742

(22) Filed: Aug. 3, 2001

(51) Int. Cl.[7] ..... B24D 3/14; B24D 3/00; B24D 3/18

(52) U.S. Cl. ..... 51/298; 51/296; 51/307; 51/309

(58) Field of Search ..... 51/296, 298, 307, 51/309, 295

(56) References Cited

U.S. PATENT DOCUMENTS 3,321,287 A * 5/1967 Hunsberger et al. ..... 51/295
6,093,225 A 7/2000 Itoh

FOREIGN PATENT DOCUMENTS

| | | |
|---|---|---|
| JP | U 55-75461 | 1/1978 |
| JP | A 63-93567 | 4/1988 |
| JP | A 4-111777 | 4/1992 |
| JP | A 10-138149 | 5/1998 |

* cited by examiner

*Primary Examiner*—Michael Marcheschi
(74) *Attorney, Agent, or Firm*—Oliff & Berridge, PLC

(57) ABSTRACT

An abrasive vitreous bonded solid mass having a vitrified abrasive structure comprising abrasive grains which are held together by an inorganic bonding agent, the abrasive structure is impregnated with a composition which comprises a resin and a solid lubricant agent. The abrasive solid mass is manufactured by preparing the composition comprising the resin and the solid lubricant agent, impregnating the vitrified abrasive structure with the composition, and curing the composition.

11 Claims, 2 Drawing Sheets

VITRIFIED ABRASIVE SOLID MASS HAVING PORES FILLED WITH RESIN, AND SOLID LUBRICANT AGENT

BACKGROUND OF THE INVENTION

1. Field of the Invention

The present invention relates in general to a vitrified abrasive solid mass such as a vitrified grinding wheel, grindstone or honing stick which has a vitrified abrasive structure impregnated with a cured composition comprising resin and solid lubricant agent.

2. Discussion of the Related Art

There is known a vitrified abrasive solid mass, having a vitrified abrasive structure, in which abrasive grains and an optionally used aggregate are held together by a glassy inorganic vitrified bonding agent, and in which a multiplicity of permeable pores or voids are formed between the abrasive grains. Owing to excellent properties of the vitrified abrasive solid mass, such as a relatively high degree of strength with which the bonding agent holds the abrasive grains together, and a relatively easy dressing operation, the vitrified abrasive solid mass is widely used for precision grinding operations. In recent years, there is a need for a vitrified abrasive solid mass capable of performing a grinding operation with improved efficiency, to meet a demand for shortening of the required grinding time.

On the other hand for practical use, there has been proposed a vitrified abrasive solid mass wherein the proportion or content of the inorganic bonding agent is made relatively high for increasing a grade of the vitrified abrasive solid mass and also a degree of strength with which the inorganic bonding agent holds the abrasive grains together. This vitrified abrasive solid mass has a relative high hardness, and can meet, to some extent, the above-indicated need for improving the grinding efficiency. However, this vitrified abrasive solid mass is not completely satisfactory. Namely, the use of the inorganic bonding agent in a relatively large proportion assures an increase in the strength of the vitrified abrasive solid mass, which contributes to an improvement in the grinding efficiency, but considerably reduces the porosity of the vitrified abrasive structure and results in difficult or insufficient fracturing and removal of the abrasive grains, leading to relatively easy glazing, clogging or fusion of the surface of the vitrified abrasive solid mass, relatively easy chipping of the abrasive structure, relatively difficult dressing operation of the vitrified abrasive solid mass, and other drawbacks encountered during use of the vitrified abrasive solid mass as a grinding tool. In addition, the use of the inorganic bonding agent in the relatively large proportion is likely to cause various drawbacks during the manufacture of the vitrified abrasive solid mass, such as cracking or deformation of the abrasive solid mass and insufficient removal or burn-out of the primary binder of the inorganic bonding agent in the firing process. The insufficient removal of the binder may cause the manufactured vitrified abrasive solid mass to have some amount of residual carbon.

Such vitrified abrasive solid mass with reduced porosity may be manufactured by heat-pressing of the materials of the grindstone, and may be used for performing a highly efficient grinding operation. However, this manner of manufacturing the vitrified grindstone requires a special manufacturing equipment which usually suffers from low manufacturing efficiency, leading to a relatively high cost of manufacture of the vitrified abrasive solid mass, and a considerable dimensional limitation of the vitrified abrasive solid mass that can be manufactured.

SUMMARY OF THE INVENTION

It is therefore a first object of the present invention to provide a vitrified abrasive solid mass which has a vitrified abrasive structure impregnated and cured with a composition comprising resin and solid lubricant agent and which is less likely to suffer from the above-indicated drawbacks such as easy glazing or clogging, while maintaining characteristics relating to its use, the easy dressing and also with a high degree of grinding efficiency.

This object may be achieved according to this invention, which provides an abrasive vitreous bonded solid mass having a vitrified abrasive structure comprising abrasive grains which are held together by an inorganic bonding agent, wherein the abrasive structure is impregnated with a cured composition which comprises a resin and solid lubricant agent.

In the vitrified abrasive structure of the present vitrified abrasive mass, a suitable volumetric percentage of the total volume of the pores, or voids is filled with the cured composition comprising resin and the solid lubricant agent, so as to prevent filling of the pores with used abrasive grains or metal chip particles which are removed from the work-piece during grinding operation using the present abrasive vitrified solid mass and which would otherwise be fused in the pores, causing clogging or glazing on the grinding surface of the vitrified abrasive solid mass. It is also noted that since the said composition filling the pores is softer than the abrasive grains, the surface of the vitrified abrasive mass is comparatively recessed at local spots corresponding to the pores filled with said composition, during the grinding operation on the work-piece, so that the abrasive grains adjacent to the surface of the abrasive structure can gradually fracture or break down and are removed, making it possible to prevent an excessive rise of the temperature on the work-piece surface caused by an excessive amount of frictional heat which would have been generated between the surface work-piece and the remaining dull abrasive grains, and also can prevent chipping of the vitrified abrasive mass while permitting easy dressing of the abrasive vitreous solid mass. The abrasive grains which are only loosely held together by the inorganic bonding agent can be reinforced with an additional bonding force provided by the cured composition comprising resin and solid lubricant agent, so that the cured resin functions to avoid early removal of those abrasive grains assuring a high grinding ratio.

It is further appreciated that the solid lubricant agent in said composition enables to replace the lubricant grinding fluids, which are used in the grinding operation, with city water or cooling air wind.

It is to be understood that the vitrified abrasive structure of the abrasive vitrified solid mass may further include such aggregates that are held together with the abrasive grains by the inorganic bonding agent.

According to a first preferred form of the invention, in the cured composition, the resin consists of at least one thermosetting synthetic resins which have been selected from a phenol resin or an epoxy resin, so that the vitrified abrasive solid mass has a higher degree of hardness than the portion of the cured composition.

According to a second preferred form of the invention, the abrasive grains include super abrasive grains (considerably fine abrasive grains) consisting of diamond abrasive grains, CBN abrasive grains, or mixture of diamond and CBN abrasive grains. The super abrasive grains preferably have Knoop hardness of at least 3000. It is also preferable that the super abrasive grains have an average particle diameter size of 20–220 $\mu$m. The particle sizes of 20 $\mu$m and 220 $\mu$m diameter correspond to 800 and 60 meshes per linear inch, respectively. Preferably, the super abrasive grains in the vitrified abrasive structure have a concentration of larger than 10 and smaller than 230, more preferably, a concentration ranging from 20 to 200.

According to a third preferred form of the invention, the vitrified abrasive structure has a porosity of 20–75% by volume, more preferably, 30–65% by volume, before the vitrified abrasive structure is impregnated with the resin.

According to a fourth preferred form of the invention the inorganic bonding agent consists of a borosilicate glass or crystallized glass which is suitable for holding super abrasive grains together. The crystallized glass may be, for example, a glass in which willemite($Zn_2$ $SiO_4$) precipitates. The inorganic bonding agent preferably has a thermal expansion coefficient ranging from $\alpha-(2\times10^{-6})$ to $\alpha+(2\times10^{-6})$ [1/K] at a temperature from room temperature to 500 degree C. (where $\alpha$ represents a thermal expansion coefficient of the super abrasive grains), so that the super abrasive grains can be tightly bonded together by the inorganic bonding agent.

According to a fifth preferred form of the invention, the vitrified abrasive structure includes 15–35% by volume of the inorganic bonding agent, so that the porosity of the vitrified abrasive structure is held in the volumetric range as described above, without deteriorating the holding strength with which the bonding agent holds the abrasive grains together. The vitrified abrasive structure may include, as an aggregate, a pore forming agent such as an inorganic ballooning agent or other inorganic hollow substance.

According to a sixth preferred form of the invention, the solid lubricant agent comprises hexagonal crystal boron nitride, molybdenum disulfide, black carbon or graphite, which are sufficiently smaller diameter than pore diameter of vitrified abrasive mass, for example, an average particle diameter of 1 $\mu$m or less. Thus, the solid lubricant agent can be evenly arranged in the structure of the vitrified abrasive solid mass so as to obtain the preferable lubricant effect.

According to the seventh preferred form of the invention, the solid lubricant agent in the composition to be impregnated into the vitrified structure is in the range from 1% to 80% by weight against the resin. If the percentage by weight is less than 1%, it is difficult to obtain the sufficient lubricant effect, and as for more than 80% the insufficient impregnation to the vitrified structure will result.

BRIEF DESCRIPTION OF THE DRAWINGS

The above and other objects, features, advantages and technical and industrial significance of this invention will be better understood by reading the following detailed description of the presently preferred embodiment of the invention, when considered in connection with the accompanying drawings, in which.

DETAILED DESCRIPTION OF PREFERRED EMBODIMENTS

Figure 1:
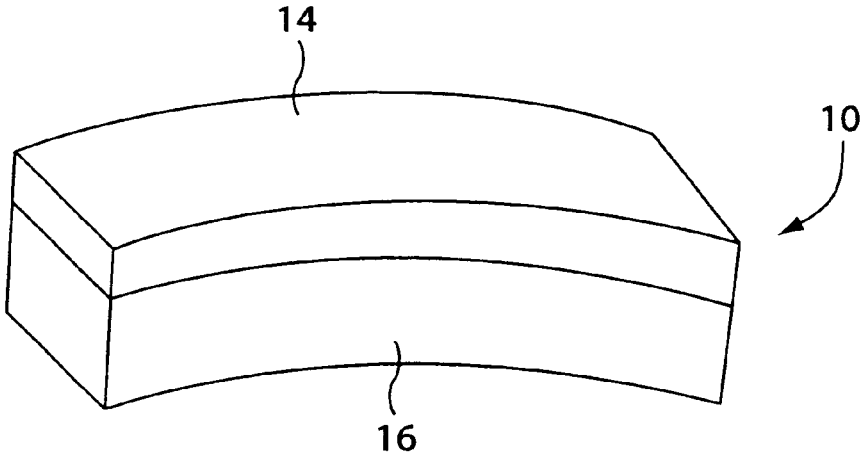
FIG. 1 is a perspective view showing one of a multiplicity of abrasive segments of a segmented vitrified grinding wheel, which abrasive segments are impregnated in the composition comprising the synthetic resin and the solid lubricant agent according to one embodiment of this invention.
Figure 2:
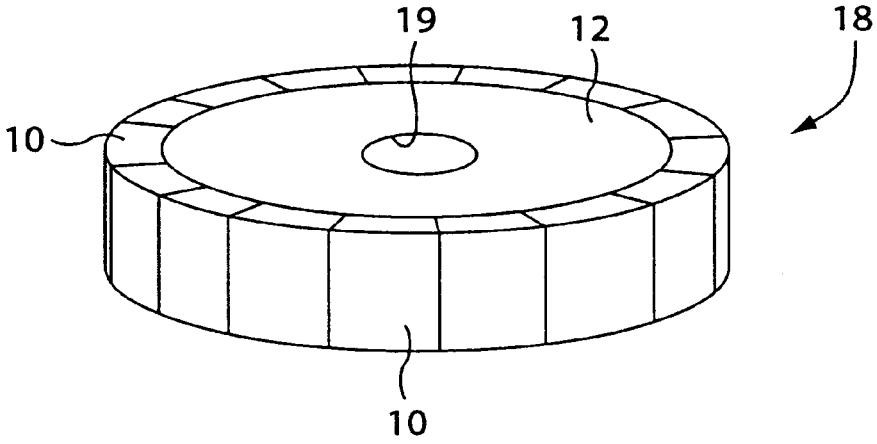
FIG. 2 is a perspective view of a segmented vitrified grinding wheel whose radially outer portion consists of the abrasive segments of the FIG. 1, which are assembled in the circumferential direction.

FIG. 1 shows an abrasive segment 10 for a segmented vitrified grinding wheel 18 in FIG. 2 constructed according to one embodiment of this invention, which abrasive segment has a vitrified abrasive structure reinforced by impregnation thereof with a said composition comprising resin and solid lubricant agent. The abrasive segment 10 is generally curved in arc shape. FIG. 2 shows a grinding wheel 18 consisting of an inner core 12, and a circular array of abrasive segments 10, which are mounted closely to the outer circumferential surface of the inner core 12 with a suitable bonding adhesive such as an epoxy resin so that there will not remain any gap or space between the adjacent abrasive segments 10. The inner core 12 is formed from a metallic material, a fiber-reinforced synthetic resin or a vitrified abrasive. The inner core 12 has in its center a mounting through-hole 19, into which a rotary shaft of a grinding machine is to be fitted.

Each abrasive segment 10 consists of a radial outer layer 14 having an outer grinding surface, and a radial inner layer 16 which is formed integrally with the outer layer 14 and which functions as a base support layer for mechanically supporting the outer layer 14. Each of the outer and inner layers 14, 16 respectively consists of abrasive grains and an inorganic bonding agent or a vitrified bond by which the abrasive grains are held together. Typically, in the outer and inner layers 14, 16 the same kind of inorganic bonding agent is used, although different kinds of abrasive grains are used. For instance, the outer layer 14 includes super abrasive grains, such as cubic-crystal boron nitride (CBN) grain or diamond abrasive grain, which have a Knoop hardness value of at least 3000, while the inner layer 16 includes ordinary ceramic abrasive grains such as fused alumina grains, silicon carbide grains or mullite grains which are relatively less expensive. Preferably, the super abrasive grains used in the outer layer 14 have an average particle size within a range of 20–220 $\mu$m. The lower and upper limits of 20 $\mu$m and 220 $\mu$m correspond to 800 and 60 meshes per linear inch respectively.

Figure 3:
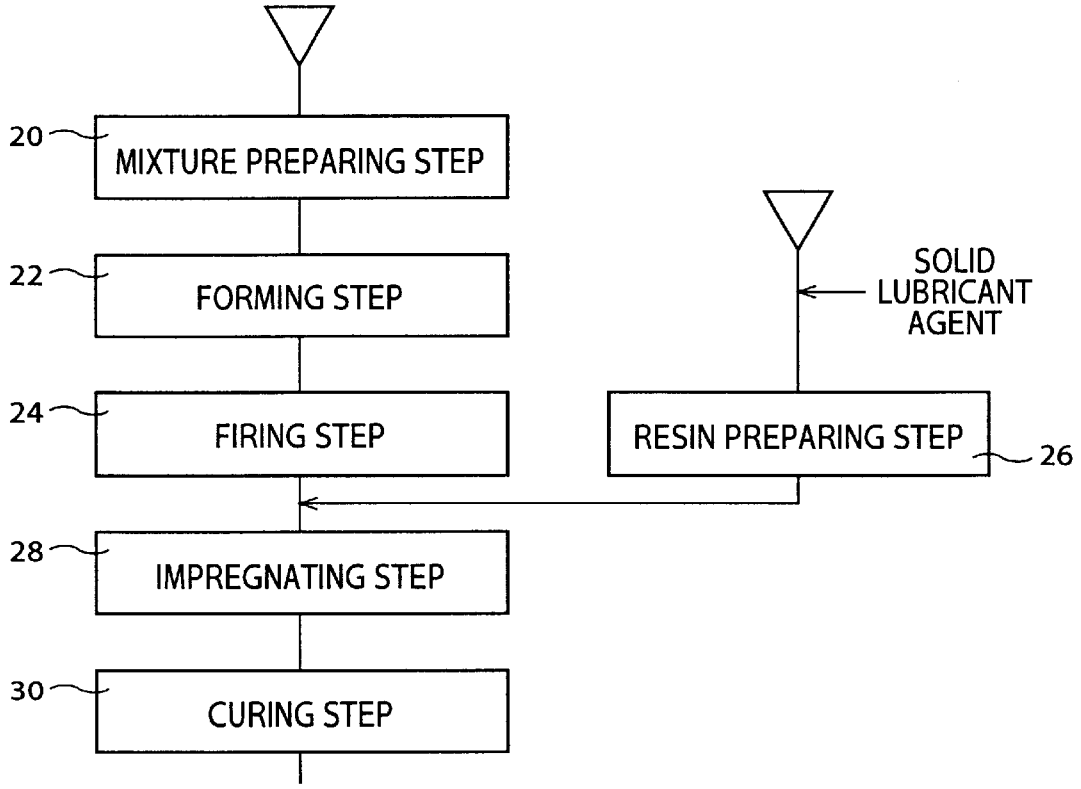
FIG. 3 is a view illustrating a process of manufacturing the abrasive segment of FIG. 1.

Each abrasive segment 10 used for the segmented grinding wheel 18 may be manufactured by a method illustrated in the block diagram of FIG. 3. Initially, a mixture preparing step 20 is implemented to prepare mixtures for the radial outer and inner layers 14, 16 of the abrasive segment 10. Each of the mixtures for the outer and inner layers 14, 16 includes abrasive grains, a glassy inorganic bonding agent, a caking additive such as dextrin, and optionally suitable additives such as an organic substance and an inorganic ballooning agent or other pore forming agent. Desired proportions of these materials are weighed and well mixed under stirring to prepare the mixture for each of the outer and inner layers 14, 16. In the present embodiment, the inorganic bonding agent consists of a borosilicate glass, or a crystallized glass in which willemite precipitates. The inorganic bonding agent preferably has a thermal expansion coefficient ranging from $\alpha^{-(}2\times10^{-6})$ to $\alpha+(2\times10^{-6})$ [1/K] (where $\alpha$ represents a thermal expansion coefficient of the super abrasive grains), at a temperature ranging from a room temperature to 500° C. The proportion of the inorganic bonding agent is determined so that the fired vitrified abrasive structure of the abrasive segment 10 includes 15–35% by volume of the inorganic bonding agent. For example, the mixture for the outer layer 14 is prepared by mixing 18.0 parts by weight of a vitrified boding agent and 10.0 parts by weight of a caking additive into 50.0 parts by weight of CBN abrasive grains (type-I#80/#100 available form GE company), while the mixture for the inner layer 16 is prepared by mixing 18.0 parts by weight of a vitrified bonding agent and 10.0 parts by weight of a caking additive into 50.0 parts by weight of silicon carbide abrasive grains (#80).

The mixture-preparing step 20 is followed by a forming step 22 in which the prepared mixtures for the radial outer and inner layers 14, 16 respectively are introduced into a suitable metal mold whose cavity has a shape following the abrasive segment 10 to be manufactured. The mixtures in the mold are compressed or compacted by a press, to form an unfired or green precursor for the abrasive segment 10. Then, a firing step 24 is implemented to fire or burn the unfired precursor at a temperature of about 900° C., so as to obtain the fired abrasive segment 10 having, for example, a length of 40 mm, a width of 10.4 mm and a thickness of 7.4 mm. In this firing step 24, the caking additive included in the mixture is burnt out, while the inorganic bonding agent is fused to bond or combine the abrasive grains together, wherein the abrasive segment 10 has a porous vitrified abrasive structure having a continuous network of pores or voids, at the same time, the abrasive grains are held together by the inorganic bonding agent. In this abrasive vitrified structure, the abrasive grains have a concentration of 10–230, preferably, 20–200. The vitrified abrasive structure has a porosity of 20–75% by volume, preferably, 30–65% by volume.

In the meantime, a preparing step 26 is implemented to prepare a composition by mixing a liquid phenol resin and, as a solid lubricant agent, a hexagonal crystal boron nitride of less than 1 $\mu$m in the average diameter and 1–80% by weight against phenol resin. For example, the liquid phenol resin 100 by weight, PR-9400 (available from Sumitomo Durez Company, Ltd), and the hexagonal crystal boron nitride 15 by weight, DENKA-BORON- NITRIDE (available from DENKI KAGAKU K.K.) are mixed and stirred for 3 minutes to use in relatively lower viscosity.

In the following impregnating step 28, the fired vitrified abrasive structure of the abrasive segment 10 which has the network of the multiple continuous pores, is impregnated with the mixture obtained in the resin preparing step 26, so that the liquid phenol resin (thermosetting synthetic resin) and the hexagonal crystal boron nitride contained in the mixture are dispersed evenly into the entirety of the porous vitrified abrasive structure. This impregnating step 28 may be performed: by pouring the mixture in the fluid or liquid state to such a suitable container made of stainless that the mass of the fluid or liquid mixture in the container has a depth of about 10 mm; immersing the entirety of the abrasive segment 10 (which has been formed and fired in the forming and firing steps 22, 24) into the mass of the composition; and evacuating the abrasive segment 10 so that the network of the continuous pores is filled with the composition. However, only a selected portion of the abrasive segment 10 may be immersed in the mass of the fluid or liquid composition.

The impregnating step 28 is followed by a curing step 30 of holding the composition-impregnated abrasive segment 10 in a suitable drier, at a suitable temperature for a suitable length of time, for instance, at 180° C. for two hours. This curing step 30 may be implemented after the composition which sticks to the surface of the abrasive segment 10 without permeating into the abrasive segment 10, is removed with a suitable cloth.

The abrasive segments 10, each of which is manufactured according to the method as described above, are bonded to the outer circumferential surface of the inner core 12 having an outside diameter of $\phi$366 mm, with an epoxy resin adhesive, so that the grinding wheel 18 as shown in FIG. 2 is formed.

In the vitrified abrasive structure of each of the abrasive segments 10 of the grinding wheel 18, a suitable percentage of the total volume of the pores or voids is filled with the cured composition, in order to prevent filling of the pores with metal chip particles which are removed from the work-piece during a grinding operation with the grinding wheel 18 and which would otherwise be fused in the pores, causing clogging or glazing on the grinding surface of each abrasive segment 10. It is also noted that since the composition filled in the pores is softer than the abrasive grains, the surface of the abrasive segment 10 is comparatively recessed at local spots corresponding to the composition-filled pores, during the grinding operation on the work-piece, so that the abrasive grains adjacent to the surface of the abrasive segment 10 gradually fracture or break down and can be easily removed, making it possible to prevent an excessive rise of the temperature on the work-piece surface due to an excessive amount of frictional heat which would be generated between the work-piece surface and the remaining dull abrasive grains, and also prevent chipping of the abrasive segment 10 while permitting easy dressing of the vitrified solid abrasive mass. The abrasive grains which are only loosely held together by the inorganic bonding agent can be tightly reinforced together with an additional bonding force provided by the cured composition including resin, so that the cured resin in the composition functions to avoid early removal of those abrasive grains, assuring a high grinding ratio and at same time, the solid lubricant agent functions to enable to replace grinding fluids which are used in the grinding operation with city water or cooling air wind.

It is further appreciated that the above-described method merely requires the impregnating step 28 and the curing step 30, in addition to the conventional method performed for the manufacturing steps of the vitrified grindstone, and does not require special equipment such as heat-pressing equipment, which usually suffers from low manufacturing efficiency and dimensional limitations in the abrasive segment that can be manufactured.

Experiments were conducted to clarify a relationship between the grinding performance of the grinding wheel 18 using the abrasive segments 10 and the vitrified abrasive structure filled with the cured composition comprising the resin and the solid lubricant agent.

EXAMPLES

The inner core portion 12 of the grinding wheel 18 manufactured in this experiment is a steel disk having the center mounting hole 19. Radial outer and inner layers 14, 16 of the abrasive segments 10 for the wheel 18 have the following compositions respectively:

Radial Outer Layer 14
- CBN grains (Type-I#80/100 available from G E company) . . . 50.0 (parts by volume)
- Vitrified bonding agent . . . 18.0 (parts by volume)
- Caking additive . . . 10.0 (parts by volume)

Radial Inner Layer 16
- Silicon carbide grains (#80) . . . 50.0 (parts by volume)
- Vitrified bond agent . . . 18.0 (parts by volume)
- Caking additive . . . 10.0 (parts by volume)

An unfired or green abrasive structure formed of the above-indicated compositions were fired at 900° C. for five hours, to prepare each abrasive segment 10 having a length of 70 mm (as measured in the circumferential direction of the grinding wheel 18), a width of 7.4 mm (corresponding to the thickness or axial dimension of the grinding wheel 18) and a thickness of 7.4 mm. The radial outer layer 14 had a thickness of 3.8 mm while the radial inner layer 16 had a thickness of 3.6 mm.

As for Test Sample #1, the composition was prepared with the phenol resin 100.0 part by weight (PR-9400 available from Sumitomo Durez Company, Ltd.), and the hexagonal crystal boron nitride 15.0 part by weight (SP-2 available from Denki Kagaku K.K.). After stirring the composition for three minutes, the segment 10 was impregnated with this composition and cured. As for Reference Sample #1, the segment 10 was impregnated with the phenol resin without the hexagonal crystal boron nitride and cured. As for Reference Sample #2, the segment 10 is not impregnated.

In the Table 1, unit of the Bending Test is Mpa and all other units are shown in the percentages by volume.

TABLE 1

| | CBN Abrasive Grain | Inorganic Bond | Phenol Resin | Solid Lubricant Agent | Pore | Bending Strength |
|---|---|---|---|---|---|---|
| Test Sample #1 | 50.0 | 18.0 | 21.4 | 2.8 | 7.8 | 65.0 |
| Reference Sample #1 | 50.0 | 18.0 | 22.4 | 0.0 | 9.6 | 68.0 |
| Reference Sample #2 | 50.0 | 18.0 | 0.0 | 0.0 | 32.0 | 52.0 |

Using the grinding wheels which are assembled with above segment samples, grinding tests were performed on a cylindrical grinding machine, in the following conditions:

(Grinding Test I)

Dimensions of Grinding Wheel: 380 mm(out side diameter)×10.0 mm(thickness)×80 mm(inside diameter)

Work-piece: Cylindrical shape 60 mm(diameter)×5 mm(width) SCM435

Type of Grinding Operation: Plunge grinding to reduce diameter of work-piece from 60 mm to 37 mm, using a grinding fluid (emulsion water-soluble grinding liquid)

Peripheral Speed of Grinding Wheel: 160 mm per second

Grinding Efficiency: 70 $mm^3$/mm

The Table 2 shows the results of the Grinding Test for the Test Sample 1, the Reference Samples 1 and 2 respectively.

TABLE 2

| | Test Sample 1 | Reference Sample 1 | Reference Sample 2 |
|---|---|---|---|
| Impregnation Agent | Resin and the solid lubricant | Resin | None |
| Grinding Ratio | 4000 | 2300 | 1200 |
| Condition of Ground Surface | Good | Slightly burnt | Burnt |
| Fusion of Work chip | None | Found | Found |
| Chipping of Grinding Wheel | None | None | Found |

The Table 3 shows the results when the grinding fluid is replaced by city water while the other conditions of Grinding Test I remain same.

TABLE 3

| | Test Sample 1 | Reference Sample 1 | Reference Sample 2 |
|---|---|---|---|
| Impregnation Agent | Resin and the solid lubricant | Resin | None |
| Grinding Ratio | 3000 | 1300 | 700 |
| Condition of Ground Surface | Good | Burnt | Burnt |
| Fusion of Work chip | None | Found | Found |
| Chipping of Grinding Wheel | None | None | Found |

From the Table 2 it will be understood that the Test Sample 1 obtained the grinding ratio about 1.7 times and about 3.3 times as high as the grinding ratios of Reference Samples 1 and 2 respectively. It represents the less consumption of the grinding wheel, which performs more eminent results in the relatively expensive vitrified grinding wheel which contains diamond or cubic boron nitride as the super abrasive grains.

At the same time, in the Test Sample 1 compared to the Reference Sample 1, the better performance in the ground surface condition of clearing out the fusion of work-chip is also noted.

From the Table 3, when the city water is used replacing for the grinding fluids, the Test Sample 1 obtained the grinding ratio abut 2.3 times and about 4.2 times as high as the grinding ratio of Reference Samples 1 and 2 respectively with less consumption of the grinding wheel and without the burning problem on the ground surface.

Although the presently preferred embodiment of the present invention have been described above with a certain degree of particularity, by reference to the accompanying drawings, it is to be understood that the invention is not limited to the details of the illustrated embodiment, but may be otherwise embodied.

In the above-illustrated embodiment, the phenol resin is used as the thermosetting synthetic resin for impregnating the vitrified abrasive structure. However, the phenol resin may be replaced by one- or two-liquid epoxy resin, or even by a thermoplastic synthetic resin such as urethane resin and polyvinyl alcohol. When the two-liquid epoxy resin is prepared, for example, a fluid or liquid hardening agent which includes polyamide resin is mixed into fluid or liquid primary agent epoxy resin such as bisphenol A.

In the above-illustrated embodiment, the abrasive solid mass takes the form of the abrasive segment 10 which consists of the radial outer layer 14 assigned to perform a grinding operation and the radial inner layer 16 backing up the outer layer 14. However, the abrasive segment may consist of the single layer formed of the homogeneous composition of the outer layer 14. Further, the abrasive solid mass may take the form of an elongated horning bar or a super-finishing block.

While the radial outer layer 14 of the abrasive segment 10 includes super abrasive grains such as cubic-crystal boron nitride (CBN) or diamond abrasive grains in the above illustrated embodiment, the outer layer 14 may include fused alumina abrasive grains, silicon carbide abrasive grains or other ordinary used abrasive grains, in place of the super abrasive grains.

While the grinding wheel 18 shown in FIG. 2 has a circular array of the abrasive segments 10, the grinding wheel may use a single integral annular abrasive solid mass.

It is to be understood that the invention may be embodied with various other changes, modifications and improvements, which may occur to those skilled in the art, without departing from the spirit and scope of the invention defined in the following claims.

What is claimed is:

1. An abrasive vitreous bonded solid mass having a vitrified abrasive structure which has pores and which includes abrasive grains and an inorganic bonding agent that holds said abrasive grains together, wherein said pores are partially filled with a cured composition comprising a resin and a solid lubricant agent.

2. An abrasive vitreous bonded solid mass according to claim 1, wherein said vitrified abrasive structure further includes aggregates that are held together with said abrasive grains by inorganic bonding agent.

3. An abrasive vitreous bonded solid mass according to claim 1, wherein the resin in said composition consists of at least one synthetic resin which is selected from a phenol resin or an epoxy resin.

4. An abrasive vitreous bonded solid mass according to claim 1, wherein said abrasive grains consist of diamond abrasive grains.

5. An abrasive vitreous bonded solid mass according to claim 1, wherein said abrasive grains consist of CBN abrasive grains.

6. An abrasive vitreous bonded solid mass according to claim 1, wherein the abrasive grains consist of mixture of diamond abrasive grains and CBN abrasive grains.

7. An abrasive vitreous bonded solid mass according to claim 1, wherein said solid lubricant agent comprised in said composition is a hexagonal crystal boron nitride.

8. An abrasive vitreous bonded solid mass according to claim 1, wherein the solid lubricant agent in said composition is 1–80% by weight based on the weight of the resin.

9. An abrasive vitreous bonded solid mass according to claim 1, wherein the abrasive grains consist of super abrasive grains, which have an average particle diameter size of 20–220 mm.

10. An abrasive vitreous bonded solid mass according to claim 1, wherein the vitrified abrasive structure has a concentration of said abrasive grains ranging from 10 to 230 parts by volume.

11. An abrasive vitreous bonded solid mass according to claim 1, wherein the vitrified abrasive structure has a porosity ranging from 20–75% by volume, before the vitrified structure is impregnated with the composition comprising the resin and the solid lubricant agent.

* * * * *